US009676582B2

(12) United States Patent
Wakabayashi

(10) Patent No.: US 9,676,582 B2
(45) Date of Patent: Jun. 13, 2017

(54) SHEET-PROCESSING APPARATUS AND IMAGE-FORMING SYSTEM

(71) Applicant: KONICA MINOLTA, INC., Chiyoda-ku, Tokyo (JP)

(72) Inventor: Hiroyuki Wakabayashi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/572,388

(22) Filed: Dec. 16, 2014

(65) Prior Publication Data

US 2015/0166283 A1 Jun. 18, 2015

(30) Foreign Application Priority Data

Dec. 16, 2013 (JP) ..... 2013-259161

(51) Int. Cl.

| | |
|---|---|
| ***B65H 39/10*** | (2006.01) |
| ***B65H 29/60*** | (2006.01) |
| ***B65H 37/04*** | (2006.01) |
| ***G03G 15/00*** | (2006.01) |

(52) U.S. Cl.

CPC ..... *B65H 29/60* (2013.01); *B65H 37/04* (2013.01); *G03G 15/6541* (2013.01); *B65H 2301/4213* (2013.01); *B65H 2511/10* (2013.01); *B65H 2511/30* (2013.01); *B65H 2511/415* (2013.01); *B65H 2515/112* (2013.01)

(Continued)

(58) Field of Classification Search

CPC ..... B65H 29/00; B65H 29/20; B65H 29/22; B65H 29/58; B65H 29/60; B65H 33/00;

(Continued)

(56) References Cited

U.S. PATENT DOCUMENTS

2005/0067777 A1* 3/2005 Ilda ..... B65H 29/60 271/303
2007/0096380 A1* 5/2007 Okumura ..... B65H 29/12 270/58.08

(Continued)

FOREIGN PATENT DOCUMENTS

JP 2001039608 A 2/2001
JP 2004262563 A 9/2004

(Continued)

OTHER PUBLICATIONS

Chinese Office Action (and English translation thereof) dated Jul. 5, 2016, issued in counterpart Chinese Application No. 201410777899.8.

*Primary Examiner* — Prasad Gokhale
(74) *Attorney, Agent, or Firm* — Holtz, Holtz & Volek PC

(57) ABSTRACT

In a sheet-processing apparatus, a controller controls a conveying guide to change over a sheet-conveying path of sheets that are ejected without stapling them to a sheet-processing conveying path based on predetermined sheet-conveying path selection information when judging that a non-stapling mode in which the sheet stapling processing is not performed on a first type of sheets follows a stapling mode in which the sheet-stapling processing is performed on a second type of sheets. The first type of sheets, which are not to be stapled, conveyed on the sheet-processing conveying path waits on a waiting portion in the non-processing mode while in the processing mode, a sheet-processing portion performs the sheet processing on the second type of sheets.

18 Claims, 7 Drawing Sheets

(52) U.S. Cl.
CPC ..... ; *B65H 2801/27* (2013.01); *G03G 2215/00734* (2013.01); *G03G 2215/00742* (2013.01); *G03G 2215/00751* (2013.01); *G03G 2215/00827* (2013.01)

(58) Field of Classification Search
CPC .... B65H 33/06; B65H 39/10; B65H 2301/21; B65H 2301/211; B65H 2301/212; B65H 2301/22; B65H 2301/43; B65H 2301/434; B65H 2408/12; B65H 2551/00; B65H 2551/10; B65H 2801/27; B65H 37/04
See application file for complete search history.

(56) References Cited

U.S. PATENT DOCUMENTS

| | | | | |
|---|---|---|---|---|
| 2007/0108690 | A1* | 5/2007 | Hayashi | B65H 29/02 270/58.27 |
| 2010/0270725 | A1* | 10/2010 | Nakajima | B65H 29/60 270/58.3 |
| 2011/0285071 | A1* | 11/2011 | Miyake | G03G 15/6541 270/58.07 |
| 2012/0207565 | A1* | 8/2012 | Yamamoto | B65H 37/04 412/6 |
| 2012/0211934 | A1* | 8/2012 | Kotani | B65H 29/51 270/58.07 |
| 2013/0313770 | A1* | 11/2013 | Hattori | B65H 39/00 270/58.07 |

FOREIGN PATENT DOCUMENTS

| | | | |
|---|---|---|---|
| JP | 2006137550 | A | 6/2006 |
| JP | 2012083666 | A | 4/2012 |
| JP | 2013018561 | A | 1/2013 |

* cited by examiner

FIG. 4

| | | |
|---|---|---|
| 110 SHEET-CONVEYING PATH SELECTION INFORMATION | SAME CONVEYING PATH MODE | CONVEYING PATH CHANGE MODE |
| 110a SHEET NUMBER INFORMATION | 5 SHEETS OR LESS | MORE THAN 5 SHEETS |
| 110b PROCESSING TIME INFORMATION | t2>t3 | t2≦t3 |
| 110c PAPER WEIGHT INFORMATION | 50g/$m^2$ OR MORE AND LESS THAN 301g/$m^2$ | LESS THAN 50g/$m^2$ OR 301g/$m^2$ OR MORE |
| 110d SHEET SIZE INFORMATION | A4 SIZE OR LESS | MORE THAN A4 SIZE |
| 110e ALIGNMENT INFORMATION | NO ALIGNMENT | ALIGNMENT |

FIG. 5

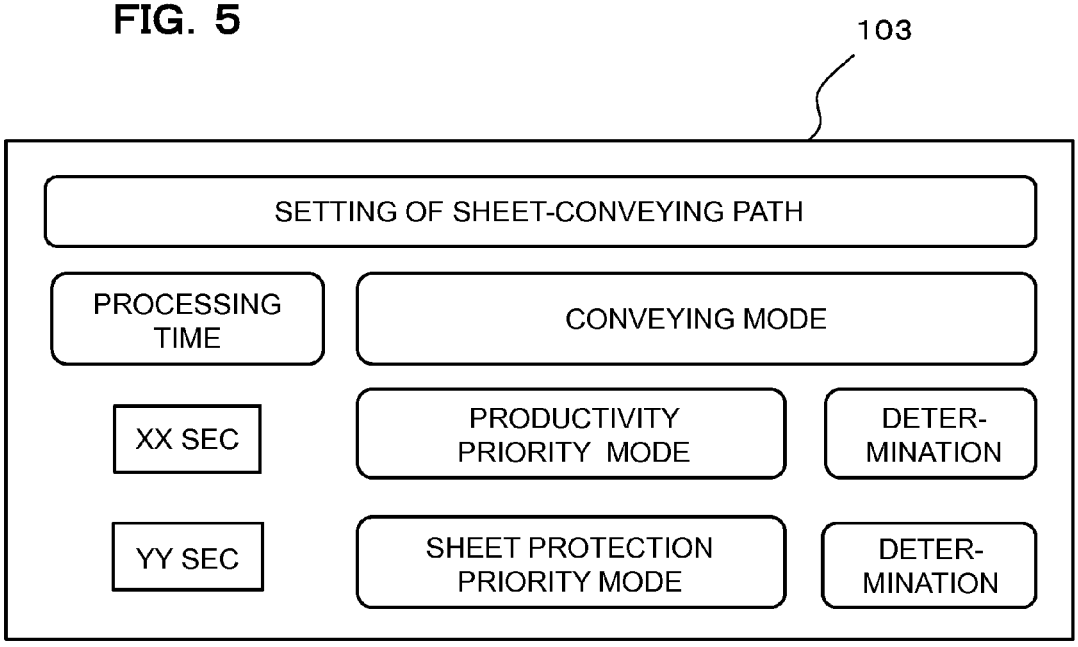

SHEET-PROCESSING APPARATUS AND IMAGE-FORMING SYSTEM

CROSS REFERENCE TO RELATED APPLICATION

The present invention contains subject matter related to Japanese Patent Application No. JP 2013-259161 filed in the Japanese Patent Office on Dec. 16, 2013, the entire contents of which being incorporated herein by reference.

BACKGROUND OF THE INVENTION

Technical Field

The present invention relates to a sheet-processing apparatus that performs any sheet processing on the sheets and ejects the sheets. It also relates to a sheet-processing apparatus having a conveying path on which sheets to be ejected without being performed any sheet processing thereon are conveyed and the other conveying path on which sheets to be ejected with performing any sheet processing thereon are conveyed. Further, it relates to an image-forming system using such a sheet-processing apparatus.

Background Art

The sheet-processing apparatus that performs any sheet processing on the sheets and ejects the sheets is generally available by combining it with an image-forming apparatus that forms an image on each of the sheets and ejects the sheets. For example, Japanese patent application publication No. 2013-018561 discloses the sheet-processing apparatus that staples the sheets as the sheet-processing and ejects them. The sheet-processing apparatus can select a stapling mode that is an operation mode in which sheets fed from an image-forming apparatus are stapled and they are ejected and a non-stapling mode in which the sheets fed from an image-forming apparatus are ejected without being stapled. It also discloses such a configuration that the conveying path on which the sheets are ejected without being stapled are conveyed is separately provided in addition of the conveying path that go by the way of a sheet-stapling portion for stapling the sheets.

Each of Japanese patent application publications Nos. 2012-083666 and 2001-039608 discloses such a technology that the sheet-processing apparatus providing with plural sheet-conveying paths which eject the sheets fed from the image-forming apparatus detects the sheet-conveying path in which a jam occurs and can eject the sheets by change over the sheet-conveying path to another sheet-conveying path.

On the other hand, a control is performed such that in the stapling mode, sheets are conveyed on the sheet-conveying path that go by the way of the sheet-stapling portion and in the non-stapling mode, sheets are conveyed on the sheet-conveying path that does not go by the way of the sheet-stapling portion. The sheet-conveying path is not changed over from the sheet-conveying path on which the sheets are normally conveyed unless any jam occurs.

SUMMARY OF THE INVENTION

Issues to be Addressed by the Invention

However, when performing any sheet processing on the sheets and ejecting them in the sheet-processing apparatus, a length of the sheet-conveying path that extends by way of the sheet-processing portion is longer than that of the sheet-conveying path that extends not by way of the sheet-processing portion. Accordingly, there is also need of time for carrying out the sheet processing. When the non-stapling mode follows the stapling mode, the sheet-processing apparatus may slow down conveyance of the sheet(s) in the non-stapling mode in order that it does not eject the sheet ejected in the non-stapling mode prior to the ejection of the preceding sheets ejected in the stapling mode.

For example, since it normally takes longer time to staple the sheets by a sheet-stapling portion and eject them compared with conveying the sheets without going by way of the sheet-stapling portion and eject them, the sheet, which is fed from the image-forming apparatus, to be ejected in the non-stapling mode temporarily waits. When any jam occurs in the sheet-stapling portion or the like, in order to stop the conveyance of the sheets being conveyed without going by way of the sheet-stapling portion before the ejection thereof, the sheet-processing apparatus may extend an interval between the conveyance of sheet and the conveyance of next sheet.

When the non-stapling mode follows the stapling mode, there may be need of time for sheet to temporarily wait. This causes a period of processing time to be extended, which decreases a productivity of the sheet-processing apparatus. Particularly, when a few sheets are repeatedly processed in the stapling mode and the non-stapling mode, a period of processing time of the sheet-processing apparatus is added to each other for every non-stapling mode, which may result in decreasing the productivity of the sheet-processing apparatus considerably.

Means for Solving the Issues

This invention addresses the above-mentioned issues and has an object to provide a sheet-processing apparatus which suppresses any extension of the period of processing time even when a non-processing mode in which any sheet processing is not performed follows a processing mode in which any sheet processing is performed and an image-forming system using the sheet-processing apparatus.

To achieve the above-mentioned the object, a sheet-processing apparatus reflecting one aspect of this invention contains a main conveying path in which a first type of sheet is conveyed and a sheet processing is not performed on the first type of sheet, a branch path in which a second type of sheet is conveyed and the sheet processing is performed on the second type of sheet, the branch path being branched out of the main conveying path, a waiting portion that allows the first type of sheet conveyed in the branch path to wait, a sheet-processing portion that performs the sheet processing on the second type of sheet conveyed in the branch path, and a controller which determines sheet-conveying path in which a sheet is conveyed between the main conveying path and the branch path, wherein the controller changes over the sheet-conveying path for the first type of sheet to the branch path based on predetermined sheet-conveying path selection information when judging that a non-processing mode in which the sheet processing is not performed on the first type of sheet follows a processing mode in which the sheet processing is performed on the second type of sheet, and wherein the controller allows the first type of sheet conveyed on the branch path in the non-processing mode to wait on the waiting portion while in the processing mode, the sheet-processing portion performs the sheet processing on the second type of sheet.

It is desirable to provide an image-forming system including an image-forming apparatus that forms images on first and second types of sheets, and a sheet-processing apparatus that conveys the first and second types of sheets fed from the image-forming apparatus, wherein the sheet-processing apparatus contains a main conveying path in which a first type of sheet is conveyed and a sheet processing is not performed on the first type of sheet, a branch path in which a second type of sheet is conveyed and the sheet processing is performed on the second type of sheet, the branch path being branched out of the main conveying path, a waiting portion that allows the first type of sheet conveyed in the branch path to wait, a sheet-processing portion that performs the sheet processing on the second type of sheet conveyed in the branch path, and a controller which determines a sheet-conveying path in which a sheet is conveyed between the main conveying path and the branch path, wherein the controller changes over the sheet-conveying path for the first type of sheet to the branch path based on predetermined sheet-conveying path selection information when judging that a non-processing mode in which the sheet processing is not performed on the first type of sheet follows a processing mode in which the sheet processing is performed on the second type of sheet, and wherein the controller allows the first type of sheet conveyed on the branch path in the non-processing mode to wait on the waiting portion while in the processing mode, the sheet-processing portion performs the sheet processing on the second type of sheet.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 4 is a table showing an example of sheet-conveying path selection information;

FIG. 5 is a diagram showing an example of a screen of a manipulation portion by which a user selects a same conveying path mode and a conveying path change mode;

DESCRIPTION OF THE PREFERRED EMBODIMENTS

The following will describe configuration examples of the sheet-processing apparatus and the image-forming system as preferred embodiments relating to the invention with reference to drawings. It is to be noted that the description in the embodiments is exemplified and any technical scope of the claims and/or meaning of term(s) claimed in the claims are not limited thereto.

Figure 1:
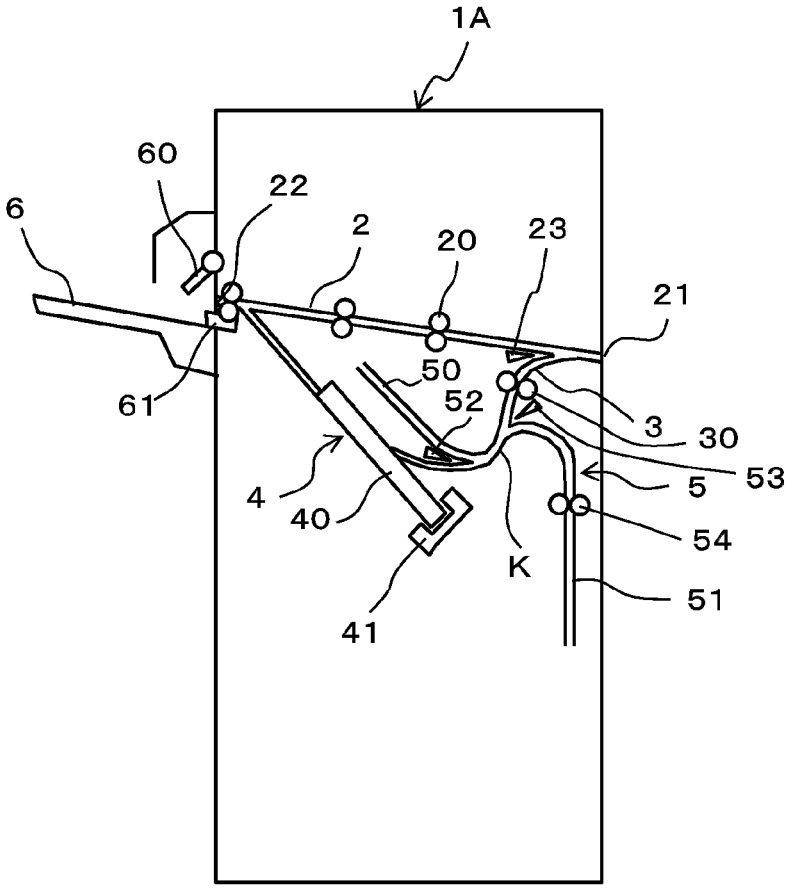
FIG. 1 is a diagram showing a configuration example of a sheet-processing apparatus according to an embodiment of this invention.
Figure 2:
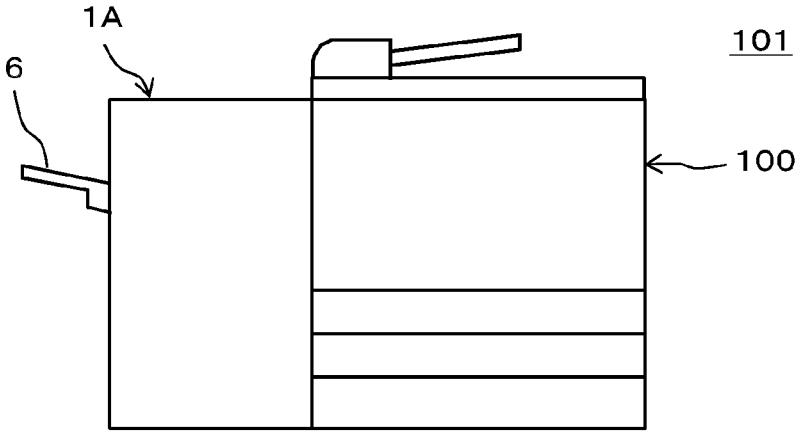
FIG. 2 is a diagram showing a configuration example of an image-forming system according to an embodiment of this invention incorporating the sheet-processing apparatus therein.

Configuration Examples of Sheet-Processing Apparatus and Image-Forming System The following will describe the sheet-processing apparatus 1A and the image-forming system 101 according to the embodiments of the invention. FIG. 1 shows a configuration example of the sheet-processing apparatus 1A. FIG. 2 shows a configuration example of the image-forming system 101. It is to be noted that ratios and dimensions in drawings are shown in an exaggerated way for convenience of explanation and the ratios may be different from real ones.

As shown in FIG. 2, the sheet-processing apparatus 1A according to the embodiment of the invention and an image-forming apparatus 100 that forms images on sheets and ejects them constitute the image-forming system 101 with the sheet-processing apparatus 1A and the image-forming apparatus 100 being combined. The sheet-processing apparatus 1A is also referred to as "post-processing apparatus" that performs any predetermined processing on the sheets on each of which an image has been formed in the image-forming apparatus 100. In this embodiment, the sheet-processing apparatus 1A has a function to staple sheets by a staple. In addition, the image-forming system 101 may include other post-processing apparatus having another function between the image-forming apparatus 100 and the sheet-processing apparatus 1A.

The sheet-processing apparatus 1A contains a main conveying path 2 in which sheets not to be stapled are conveyed and a sheet-processing conveying path 3 as a branch path that is branched from the main conveying path 2. The sheet-processing apparatus 1A also contains a sheet-stapling portion 4 that staples the sheets conveyed in the sheet-processing conveying path 3 and a waiting portion 5 that allows the sheet(s) conveyed in the sheet-processing conveying path 3 to wait while the sheet-stapling portion 4 staples the preceding sheets. The sheet-processing apparatus 1A further contains a main tray 6 to which sheet(s) conveyed on the main conveying path 2, and sheet(s) or a bundle of sheets conveyed in the sheet-processing conveying path 3 are ejected.

The sheet-processing apparatus 1A changes over a sheet-conveying path to the main conveying path 2 in a non-processing mode in which the sheet(s) is (are) ejected without being performed any sheet processing thereon. The sheet-processing apparatus 1A alternatively changes over the sheet-conveying path to the sheet-processing conveying path 3 in the processing mode in which the sheet is ejected with performing any sheet processing thereon.

Specifically, the sheet-processing apparatus 1A changes over the sheet-conveying path to the main conveying path 2 in the non-processing mode in which the sheets are ejected without being stapled. The sheet-processing apparatus 1A changes over the sheet-conveying path to the sheet-processing conveying path 3 in the processing mode in which the sheets are ejected with stapling them.

On the other hand, when the non-processing mode follows the processing mode, the sheet-processing apparatus 1A selects a same conveying path mode in which the sheet-conveying path for a sheet to be ejected without being performed any sheet-processing is the sheet-processing conveying path 3 or a conveying path change mode in which the sheet-conveying path for a sheet to be ejected without being performed any sheet-processing is the main conveying path 2, based on predetermined and stored sheet-conveying path selection information.

In other words, when the non-stapling mode follows the stapling mode, the sheet-processing apparatus 1A selects the same conveying path mode in which the sheet-conveying path for the sheet to be ejected without being performed any sheet-processing is the sheet-processing conveying path 3 or the conveying path change mode in which the sheet-conveying path for the sheet to be ejected without being performed any sheet-processing is the main conveying path 2, based on the predetermined and stored sheet-conveying path selection information.

When the non-processing mode follows the processing mode, the sheet-processing apparatus 1A selects the sheet-processing conveying path 3 as the sheet-conveying path for the sheet to be ejected without being performed any sheet-processing, based on sheet number, paper weight, size or the like of the sheet set as the sheet-conveying path selection information.

Namely, when the non-stapling mode follows the stapling mode, the sheet-processing apparatus 1A selects the sheet-processing conveying path 3 as the sheet-conveying path for the sheet to be ejected without being performed any sheet-processing, based on the sheet number, paper weight, size or the like of the sheet set as the sheet-conveying path selection information. This allows conveying the sheets to be stapled and the sheets not to be stapled alternately on the sheet-processing conveying path 3. This also allows to shorten a period of waiting time for the sheet(s) to be ejected in the non-stapling following the stapling mode so that the productivity of the sheet-processing apparatus 1A is improved.

The following will describe the sheet-processing apparatus 1A more in detail. The main conveying path 2 includes conveying rollers 20 or the like for conveying the sheet and guiding the conveyance thereof. The main conveying path 2 constitutes the sheet-conveying path in which the sheets fed from the image-forming apparatus 100 or the like are conveyed without stapling them.

It is preferable that in a configuration in which the conveying rollers 20 and the like convey the sheet with the conveying rollers holding it therebetween, the sheet-conveying path is a conveying path in which any load exerted on the sheet is lightened, taking into consideration tranquility when conveying the sheet, any damage in the sheet, and a frequency of jam.

Particularly, when a thick sheet having high stiffness is conveyed on a sheet-conveying path having a curved portion in which the thick sheet is bent along the surface direction thereof, such a thick sheet is unfavorable for generating any noise by increasing the load when conveying it, generating any damage on the thick sheet and generating jam. Conversely, when a thin sheet having low stiffness is conveyed on a sheet-conveying path having a curved portion, the thin sheet is subject to bendiness so that jam or corner fold may occur.

Accordingly, it is preferable to provide the sheet-processing apparatus 1A with a linear sheet-conveying path, taking thickness of the sheet into consideration. The sheet-processing apparatus 1A contains a sheet-receiving portion 21 that receives sheet(s) fed from an apparatus such as the image-forming apparatus 100 provided at an upstream side of the sheet-processing apparatus 1A, a sheet-ejecting portion 22 through which the sheets are ejected to the main tray 6, and the linear main conveying path 2 between the sheet-receiving portion 21 and the sheet-ejecting portion 22. On the main conveying path 2, the sheet(s) on which any sheet-processing is not performed is (are) conveyed.

The sheet-processing conveying path 3 contains conveying rollers 30 and the like for conveying the sheet(s) and guiding the conveyance thereof. The conveying rollers 30 convey the sheets fed from the image-forming apparatus 100 or the like to a sheet-stapling portion 4 through the sheet-processing conveying path 3. The sheet-processing conveying path 3 constitutes a sheet-conveying path on which a bundle of the sheets stapled in the sheet-stapling portion 4 is conveyed and a sheet-conveying path on which the sheets fed from the image-forming apparatus 100 or the like are conveyed without stapling them.

The sheet-processing conveying path 3 branches out of the main conveying path 2 at downstream side of the sheet-receiving portion 21 along a conveying direction of the sheet conveyed from the sheet-receiving portion 21 to the sheet-ejecting portion 22. The sheet-processing conveying path 3 also joins the main conveying path at an upstream side of the sheet-ejecting portion 22 to be able to eject the sheet(s) to the main tray 6.

The sheet-processing conveying path 3 is configured to have a curved portion between a branched portion from the main conveying path 2 and a joined portion to the main conveying path 2 to convey the sheets to the sheet-stapling portion 4 positioned below the main conveying path 2.

The sheet-processing apparatus 1A contains a conveying guide 23 that changes over the sheet-conveying path for the sheet received from the sheet-receiving portion 21 to the main conveying path 2 or the sheet-processing conveying path 3. The conveying guide 23 is positioned at the branched portion of the sheet-processing conveying path 3 from the main conveying path 2 and changes over the conveying direction of the sheet by means of driving means such as solenoid, which will be described later.

The sheet-stapling portion 4 includes a stacker 40 that stacks the sheets and a stapler 41 that staples the sheets stacked on the stacker 40. The stacker 40 includes a mechanism for aligning the sheets by aligning widths of the sheets and a mechanism for aligning the sheets by aligning ends of the sheets along the conveying direction thereof. The stacker 40 inclines backward along the conveying direction of the sheets. This inclination allows rear ends of the sheets stacked on the stacker 40 to be aligned. The sheet-stapling portion 4 constitutes a sheet-processing portion that performs a sheet processing on the sheets.

The stapler 41 includes a mechanism for storing staples and a mechanism for stapling the sheets using the staple(s). The stapler 41 staples the sheets stacked on the stacker 40 by the staple(s).

The waiting portion 5 allows the sheets to wait. The waiting portion 5 contains a temporary reservation part 50 that escapes the sheet conveyed on the sheet-processing conveying path 3 from the sheet-processing conveying path 3 at the upstream side of the stacker 40 and a waiting conveying path 51 to which the sheet(s) escaped to the temporary reservation part 50 is (are) conveyed. The waiting portion 5 also contains a conveying guide 52 that changes over the sheet-conveying path to the temporary reservation part 50 and a conveying guide 53 that changes over the sheet-conveying path to the waiting conveying path 51.

The temporary reservation part 50 branches out of the sheet-processing conveying path 3 at the upstream side of the stacker 40 and is configured to escape the sheet(s) conveyed on the sheet-processing conveying path 3 along the conveying direction thereof from the sheet-processing conveying path 3.

The waiting conveying path 51 contains conveying rollers 54 and the like that convey the sheet(s) and guide the conveyance thereof. The waiting conveying path 51 branches out of the sheet-processing conveying path 3 at the upstream side of a join and waiting position K set at the upstream side of the branched portion of the temporary reservation part 50 from the sheet-processing conveying path 3. The waiting conveying path 51 constitutes a sheet-conveying path on which the sheets are conveyed from the temporary reservation part 50 and a sheet-conveying path on which the sheets are conveyed to the sheet-processing conveying path 3.

The conveying guide 52 is positioned at the branched portion of the temporary reservation part 50 from the sheet-processing conveying path 3 and changes over the conveying direction of the sheets by means of driving means such as solenoid, which will be described later. The conveying guide 53 is positioned at the branched portion of the waiting conveying path 51 from the sheet-processing conveying path 3 and changes over the conveying direction of the sheets by means of driving means such as solenoid, which will be described later.

In addition, the sheet-processing apparatus 1A may be configured to have a saddle stitching bookbinding mechanism in addition to a side stitching mechanism that staples the sheets in the sheet-stapling portion 4. In this case, a sheet-conveying path on which the sheet(s) is (are) conveyed to the saddle stitching bookbinding mechanism, not shown, may be used as the waiting conveying path 51.

The main tray 6 contains an ejected-sheet-aligning plate 60 that aligns the sheets ejected from the sheet-ejecting portion 22 and a gripping portion 61 that grips the stacked sheets to mount them on a predetermined position. The ejected-sheet-aligning plate 60 and the gripping portion 61 constitute ejected-sheet-aligning means. The ejected-sheet-aligning plate 60 aligns the sheets ejected from the sheet-ejecting portion 22 and stacked on the main tray 6 by striking ends of the sheets onto the ejected-sheet-aligning plate 60. The gripping portion 61 grips the rear ends of the sheets ejected from the sheet-ejecting portion 22 and mounts them on the predetermined position on the main tray 6.

Figure 3:
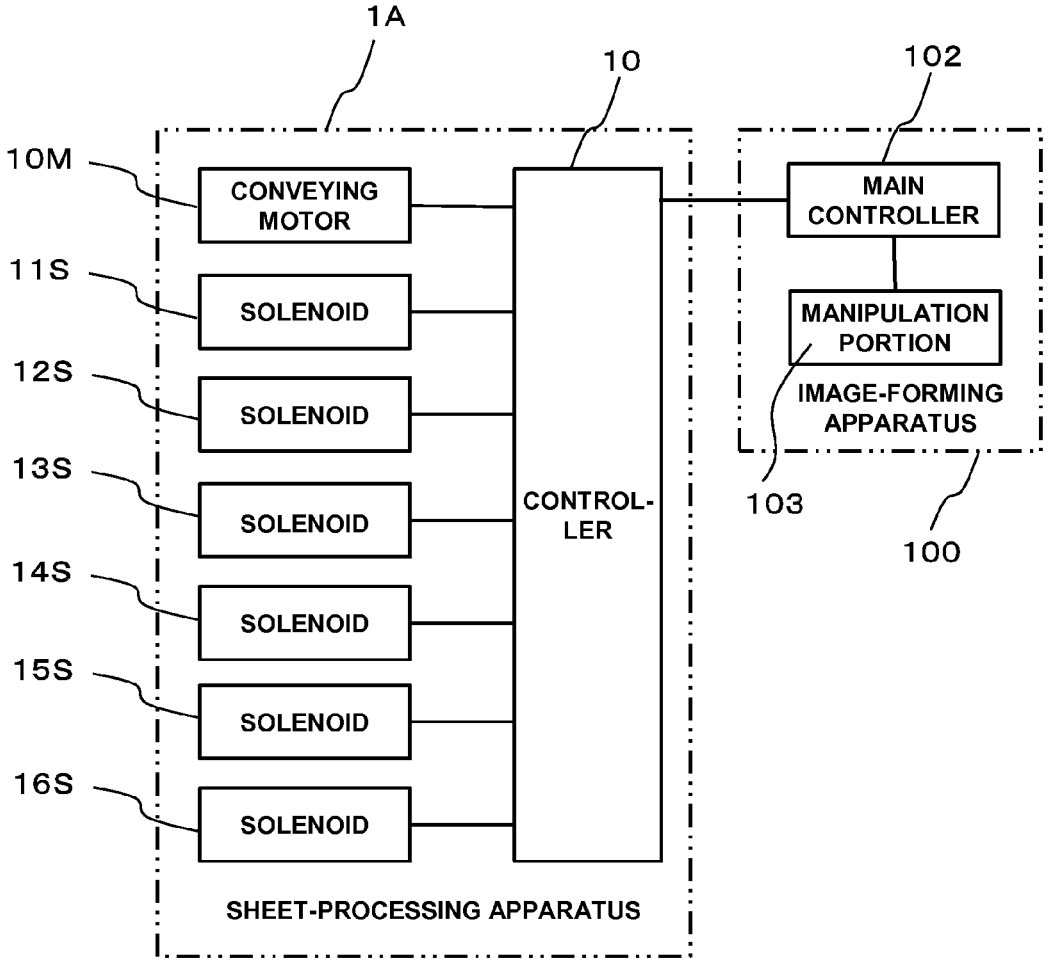
FIG. 3 is a block diagram showing a configuration example of a control system of the sheet-processing apparatus according to an embodiment of this invention.

FIG. 3 shows a configuration example of a control system of the sheet-processing apparatus according to an embodiment of this invention. The sheet-processing apparatus 1A contains a controller 10 having central processing unit (CPU) and storing means that stores program or the like to be carried out in CPU.

The sheet-processing apparatus 1A also contains a conveying motor 10M, which the controller 10 controls, for driving the conveying rollers 20 for conveying the sheet on the main conveying path 2, the conveying rollers 30 for conveying the sheet on the sheet-processing conveying path 3 and the conveying rollers 54 for conveying the sheet(s) on the waiting conveying path 51, and the like.

The sheet-processing apparatus 1A further contains a solenoid 11S that drives the conveying guide 23 for changing over the conveying direction of the sheet between the main conveying path 2 and the sheet-processing conveying path 3, a solenoid 12S that drives the conveying guide 52 for changing over the conveying direction of the sheet between the sheet-processing conveying path 3 and the temporary reservation part 50, and a solenoid 13S that drives the conveying guide 53 for changing over the conveying direction of the sheet between the sheet-processing conveying path 3 and the waiting conveying path 51.

The sheet-processing apparatus 1A additionally contains a solenoid 14S that drives the stapler 41, a solenoid 15S that drives the ejected-sheet-aligning plate 60 and a solenoid 16S that drives the gripping portion 61.

The controller 10 is an example of control means. The image-forming apparatus 100 contains a main controller 102 which sends the controller 10 any contents of a job, execution of which is instructed by the image-forming apparatus 100, such that the sheet-processing apparatus 1A executes the stapling mode or the non-stapling mode, or sheet number, size, paper weight, species or the like of the sheet to be used in each mode.

The controller 10 controls the conveying guide 23 to change over the sheet-conveying path to the sheet-processing conveying path 3 when the job to be executed is the stapling mode, and controls the conveying rollers 30 to convey the sheets in order to the sheet-stapling portion 4 through the sheet-processing conveying path 3. The controller 10 controls the sheet-stapling portion 4 to staple the sheets and controls the sheet-ejecting portion 22 and the like to eject the stapled sheets to the main tray 6.

Alternatively, the controller 10 controls the conveying guide 23 to change over the sheet-conveying path to the main conveying path 2 when the job to be executed is the non-stapling mode, and controls the conveying rollers 20 and the like to convey the sheet(s) on the main conveying path 2. The controller 10 then controls the sheet-ejecting portion 22 and the like to eject the sheet(s) to the main tray 6.

When the job to be executed is the non-stapling mode following the stapling mode, the controller 10 receives the sheet-conveying path selection information for selecting the conveying path for the sheet(s) to be ejected without stapling them in non-stapling mode from the image-forming apparatus 100. The image-forming apparatus 100 contains a manipulation portion 103 that receives any manipulation by a user. Although the manipulation portion 103 has been contained in the image-forming apparatus 100 in this embodiment, the manipulation portion 103 may be contained in the sheet-processing apparatus 1A or other apparatus.

FIG. 4 shows an example of the sheet-conveying path selection information 110. The sheet-conveying path selection information 110 is set on the basis of sheet number, paper weight, size of the sheet, a period of processing time and the like. Based on the sheet-conveying path selection information 110, a same conveying path mode in which the conveying path of sheets to be ejected without stapling them is the sheet-processing conveying path 3 or a conveying path change mode in which the conveying path of sheets to be ejected without stapling them is the main conveying path 2 is selected. It is set whether or not the alignment of sheets should be executed on the main tray 6 based on the same conveying path mode and the conveying path change mode.

In the sheet-processing apparatus 1A, when the non-stapling mode follows the stapling mode, in a case where there are a few sheets to be ejected with stapling them or a few sheets to be ejected without stapling them, a period of waiting time of the sheets is shortened so that the sheet-processing apparatus 1A obtains improved productivity. Accordingly, sheet number information 110*a* is set as the sheet-conveying path selection information 110. For example, when the sheets to be ejected without stapling them do not exceed five sheets, the same conveying path mode is selected. When the sheets to be ejected without stapling them exceed five sheets, the conveying path change mode is selected. In other words, the sheet-conveying path selection information 110 is set on the base of the sheet number information 110*a* of the sheets conveyed in the non-processing (non-stapling) mode following the processing (stapling) mode.

Thus, the sheet-processing apparatus 1A gets a larger advantage to improve productivity in a case of the continuous jobs of a few sheets but the sheet-processing apparatus 1A requires a much period of waiting time in a case of the continuous jobs of many sheets to reduce the advantage to improve productivity. Accordingly, processing time information 110*b* is set as the sheet-conveying path selection information 110.

The controller 10 calculates a period of processing time t2 that is necessary for conveying the sheets on the main conveying path 2 by sheet numbers thereof to be processed in the jobs to be executed. The controller 10 also calculates a period of processing time t3 that is necessary for conveying the sheets on the sheet-processing conveying path 3 by sheet numbers thereof to be processed in the jobs to be executed. The controller 10 changes over the sheet-conveying path based on the processing time information 110*b* which is obtained by comparing the period of processing time t2 with the period of processing time t3. For example, in a case of t2>t3 where a difference therebetween is positive, the controller 10 selects the same conveying path mode. In a case of t2≤t3, the controller 10 selects the conveying path change mode. Namely, the controller 10 calculates the period of processing time t2 that is necessary for conveying the sheets on the main conveying path 2 by sheet numbers thereof to be processed in the non-processing mode following the processing mode and the period of processing time t3 that is necessary for conveying the sheets on the sheet-processing conveying path 3 by sheet numbers thereof to be processed in the non-processing mode following the processing mode. As the sheet-conveying path selection information 110, the processing time information 110*b* is set on the basis of the comparison of the period of processing time t2 with the period of processing time t3. The controller 10 then changes over the sheet-conveying path based on the processing time information 110*b*.

Further, a user can select the same conveying path mode and the conveying path change mode by his judgment by allowing any judgment standards and the periods of processing time t2 and t3, which are calculated on the basis of the sheet number of the sheets to be processed in the jobs to be executed, to be indicted on the manipulation portion 103 or the like of the image-forming apparatus 100. FIG. 5 shows an example of a screen of the manipulation portion 103 by which the user can select the same conveying path mode and the conveying path change mode. For example, on the manipulation portion 103, the user can select a productivity priority mode in which the productivity is given priority or a sheet protection priority mode in which the sheet protection is given priority. When the user selects the productivity priority mode on the manipulation portion 103, the controller 10 selects the same conveying path mode. When the user selects the sheet protection priority mode on the manipulation portion 103, the controller 10 selects the conveying path change mode. In this case, when the controller 10 determines that the non-processing mode (non-stapling mode) follows the processing mode (stapling mode), the controller 10 changes over the sheet-conveying path of the sheets (first type of sheets) to be ejected without being performed any processing on the sheets (first type of sheets) from the main conveying path 2 to the sheet-processing conveying path 3 or vice versa based on the user's selection received by the manipulation portion 103.

There is a sheet which is unsuitable for a conveyance on a sheet-conveying path having a curved portion among species of the sheets. For example, as described above, the sheet of thick paper and the sheet of thin paper are unsuitable for a conveyance on the conveying path having the curved portion. Accordingly, paperweight information 110*c* is set as the sheet-conveying path selection information 110. The paper weight information 110*c* is an example of sheet-species information. For example, when the sheet is a sheet of thick paper having the paperweight of 301 g/m2 or more or a sheet of thin paper having the paper weight of less than 50 g/m2, the controller 10 selects the conveying path change mode. When the sheet is a sheet having the paper weight of 50 g/m2 or more and less than 301 g/m2, the controller 10 selects the same conveying path mode.

When a size of sheet to be conveyed on the sheet-processing conveying path 3 and to be stapled or waited is limited, sheet size information 110*d* is set as the sheet-conveying path selection information 110. The sheet size information 110*d* is an example of sheet-species information. For example, when the size of the sheet exceeds A4 size, the controller 10 selects the conveying path change mode. When the size of the sheet does not exceed A4 size, the controller 10 selects the same conveying path mode. The controller 10 may select the sheet-conveying path based on the species of sheet such as regular paper or special paper. Thus, the sheet-conveying path selection information 110 is set on the basis of the sheet-species information of the sheet conveyed in the non-processing mode (non-stapling mode).

When bundles of sheets stapled in the continuous jobs of a few sheets are ejected, a surface of each of the ejected bundles of sheets accumulated on the main tray 6 is not flat because of thickness of the staple and the like so that it is difficult to keep an alignment of the ejected bundles of sheets. When the bundles of sheets, each of which is not flat, are accumulated to align them, the ejected-sheet-aligning plate 60 contacts one side of each of the bundles of sheets so that they may not be aligned.

Alignment information 110*e* used for determining whether or not the alignment of sheets is performed on the main tray 6 operated together with the change-over of the sheet-conveying path from or to the same conveying path mode to or from the conveying path change mode is set as the sheet-conveying path selection information 110. In the same conveying path mode in which the sheets are stapled in the continuous jobs of a few sheets and ejected, the alignment information 110*e* is set not to align the sheets on the main tray 6 by the ejected-sheet-aligning plate 60 or the like. In the conveying path change mode in which many sheets are stapled and ejected, the alignment information 110*e* is set to align the sheets on the main tray 6. In other words, the alignment information for determining whether or not the alignment of sheets is performed on the main tray 6 is set according to the sheet-conveying path changed over in a case of the non-processing mode (non-stapling mode) following the processing mode (stapling mode). This allows to be kept the alignment of the sheets on the main tray 6. The sheet-processing apparatus 1A can improve quietness by stopping the ejected-sheet-aligning plate 60 and the like in a case of setting that is unsuitable for the alignment and can secure durability of the parts thereof.

When the non-stapling mode follows the stapling mode, the controller 10 selects the same conveying path mode or the conveying path change mode according to sheet number, paper weight, size and the like of the sheets received from the image-forming apparatus 100 based on the contents of the jobs, execution of which is indicated by the image-forming apparatus 100, and the sheet-conveying path selection information 110. The main controller 102 of the image-forming apparatus 100 controls a feed timing of the sheets to be fed to the sheet-processing apparatus 1A based on the processing of the same conveying path mode or the processing of the conveying path change mode, which is selected in the sheet-processing apparatus 1A.

Operation Example of Sheet-Processing Apparatus

Figure 6:
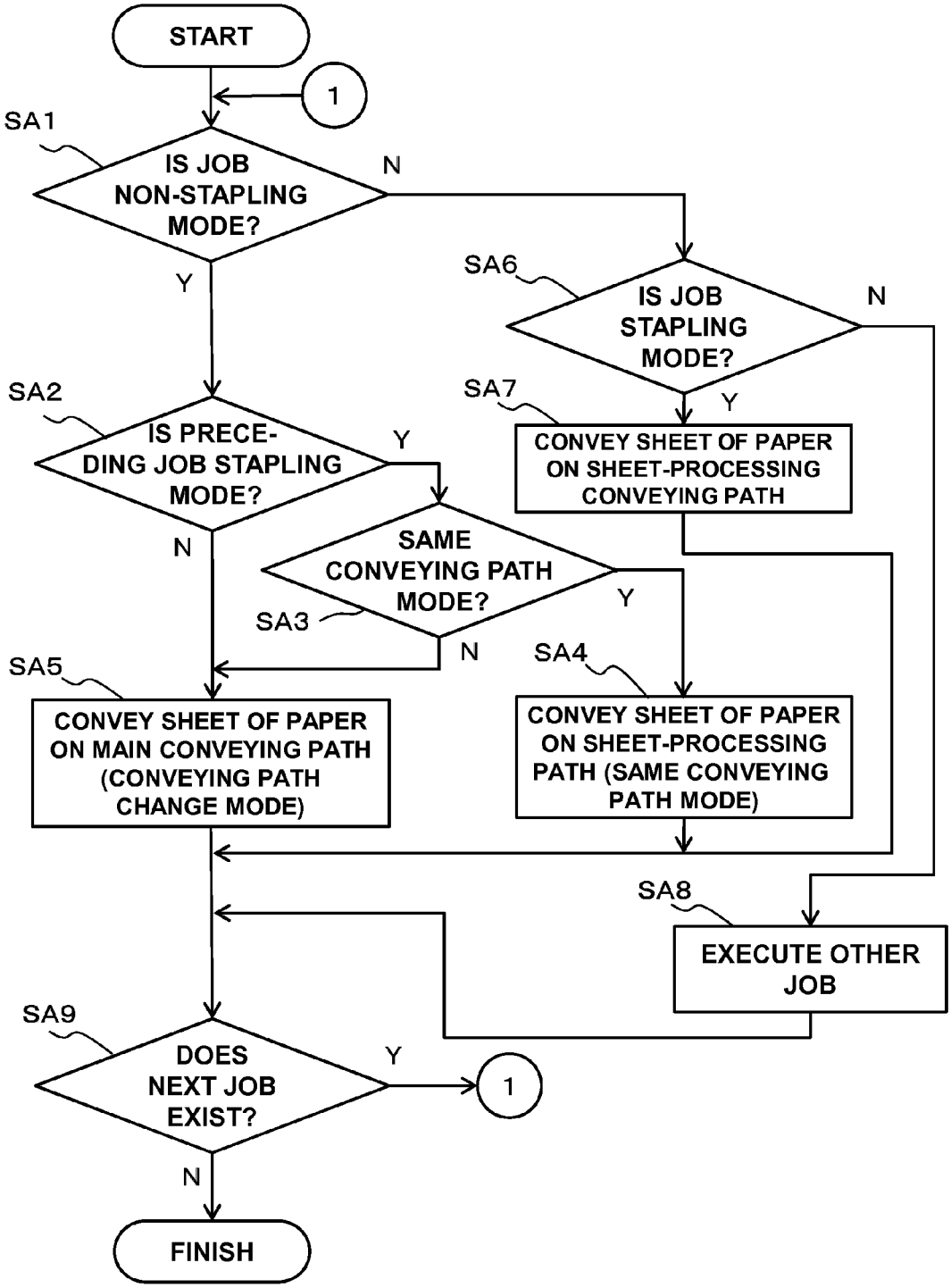
FIG. 6 is a flowchart showing an operation example of the sheet-processing apparatus.

The following will describe an operation example of the sheet-processing apparatus 1A according to an embodiment of this invention with reference to FIG. 6. FIG. 6 shows an operation example of the sheet-processing apparatus 1A which changes over the sheet-conveying path based on the jobs to be executed.

As shown in FIG. 6, at a step SA1, the controller 10 of the sheet-processing apparatus 1A judges whether or not the job to be executed is the non-stapling mode. When judging that the job to be executed is the non-stapling mode, the controller 10 judges whether or not a preceding job is the stapling mode at a step SA2. When judging that the preceding job is the stapling mode, the controller 10 judges which of the same conveying path mode in which the sheet-conveying path for the sheet to be ejected without being performed any sheet-processing is the sheet-processing conveying path 3 and the conveying path change mode in which the sheet-conveying path for the sheet to be ejected without being performed any sheet-processing is the main conveying path 2 the controller 10 selects based on the sheet-conveying path selection information 110 shown in FIG. 4, at a step SA3.

When judging that sheet number, paper weight and size of the sheet, a period of processing time or the like satisfy a condition for selecting the same conveying path mode at the step SA3, the controller 10 of the sheet-processing apparatus 1A selects the same conveying path mode at a step SA4. In the same conveying path mode, the controller 10 controls the conveying guide 23 to change over the sheet-conveying path for the sheet (first type of sheet) to be ejected without being performed any sheet-processing to the sheet-processing conveying path 3. This allows both of the sheet (first type of sheet) to be ejected without being performed any sheet-stapling processing and the sheet (second type of sheet) to be ejected with performing any sheet-stapling processing to be conveyed on the sheet-processing conveying path 3.

Regarding the sheet-conveying path selection information 110 shown in FIG. 4, when the sheet number of the sheets in the sheet number information 110*a* is a predetermined sheet number or less, the controller 10 selects the same conveying path mode. When, in the processing time information 110*b*, the period of processing time t2 that is necessary for conveying the sheets on the main conveying path 2 is shorter than the period of processing time t3 that is necessary for conveying the sheets on the sheet-processing conveying path 3, the controller 10 selects the same conveying path mode.

When the sheet is neither a sheet of thick paper nor a sheet of thin paper, which is unsuitable for being conveyed on the sheet-conveying path having a curved portion, in the paper weight information 110*c*, the controller 10 selects the same conveying path mode.

When the sheet has a size that is not more than a predetermined size of the sheet, which allows such a sheet to be conveyed on the sheet-processing conveying path 3 and be processed, in the sheet-size information 110*d*, the controller 10 selects the same conveying path mode. Here, when selecting the same conveying path mode based on the sheet-conveying path selection information 110 shown in FIG. 4, any alignment is not executed on the main tray 6.

When judging, at the step SA3, that sheet number, paper weight and size of the sheet, a period of processing time or the like satisfy a condition for selecting the conveying path change mode, the controller 10 of the sheet-processing apparatus 1A selects the conveying path change mode at a step SA5. In the conveying path change mode, the controller 10 controls the conveying guide 23 to change over the sheet-conveying path for the sheet to be ejected without being performed any sheet-stapling processing to the main conveying path 2. It is thus possible to convey the sheet to be ejected without stapling them on the main conveying path 2 and convey the sheet to be ejected with stapling them on the sheet-processing conveying path 3.

When judging, at the step SA1 shown in FIG. 6, that the job to be executed is not the non-stapling mode, the controller 10 of the sheet-processing apparatus 1A judges whether or not the job to be executed is the stapling mode at a step SA6. When judging that the job to be executed is the stapling mode, the controller 10 controls the conveying guide 23 to change over the sheet-conveying path to the sheet-processing path 3 at the step SA6. In the stapling mode, at a step SA7, the sheet to be ejected without stapling them is conveyed on the main conveying path 2 and the sheet to be ejected with stapling them is conveyed on the sheet-processing conveying path 3. When judging that the job to be executed is not the stapling mode at the step SA6, the controller 10 executes other job at a step SA8.

The controller 10 of the sheet-processing apparatus 1A judges whether or not next job exists at a step SA9 and when judging that any next job does not exist, the controller 10 finishes its operation. When judging that a next job exists, the controller 10 goes back to the step SA1.

Figure 7:
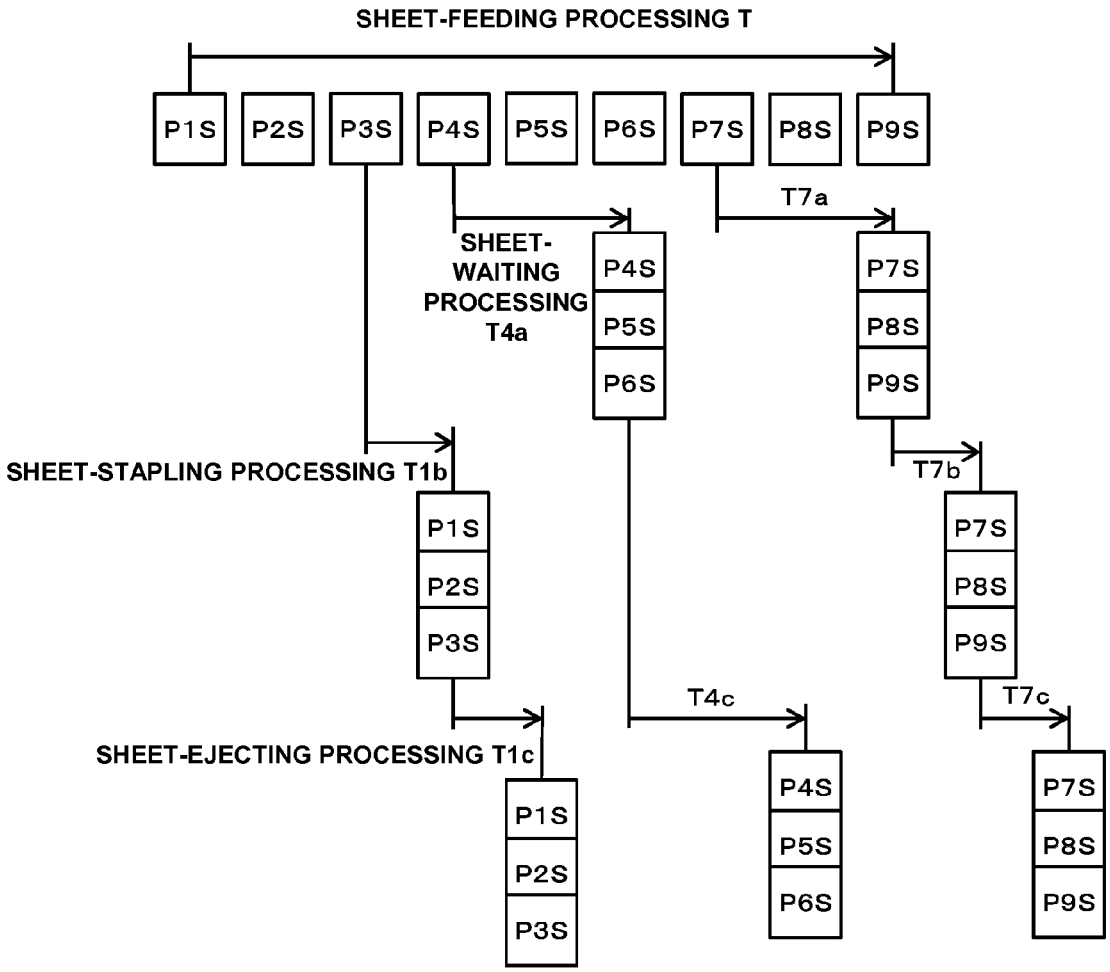
FIG. 7 is a timing chart showing an operation example of the sheet-processing apparatus when a non-stapling mode follows a stapling mode and the same conveying path mode is selected.

FIG. 7 shows an operation example of the sheet-processing apparatus 1A when the non-stapling mode follows the stapling mode and the same conveying path mode is selected. FIG. 7 schematically shows timings of sheet-feeding processing, sheet-stapling processing, sheet-waiting processing and sheet-ejecting processing. FIG. 7 shows, as a case where the non-stapling mode follows the stapling mode, a case where first three sheets are ejected with stapling them, second three sheets are ejected without stapling them, and third three sheets are ejected with stapling them. Here, the sheets P1S through P3S and P7S through P9S are to be stapled and the sheets P4S through P6S are not to be stapled.

In a case where the non-stapling mode follows the stapling mode and the same conveying path mode is selected in which the sheet-conveying path is the sheet-processing conveying path 3, the controller 10 controls the conveying guide 23 shown in FIG. 1 to change over the sheet-conveying path to the sheet-processing conveying path 3 and to convey the sheet(s) fed from the image-forming apparatus 100 to the sheet-processing conveying path 3. During the sheet-feeding proceeding T from the image-forming apparatus 100, the main controller 102 of the image-forming apparatus 100 feeds the sheets at fixed timing.

In the sheet-processing apparatus 1A, the controller 10 controls the conveying rollers 30 and the like to convey the sheets, which are fed one by one from the image-forming apparatus 100 during the sheet-feeding proceeding T, in order to the sheet-processing conveying path 3 and to accumulate them on a stacker 40. In this embodiment, the first three sheets P1S, P2S and P3S are conveyed in order on the sheet-processing conveying path 3 and are accumulated on the stacker 40.

The controller 10 controls the stapler 41 to perform the sheet-stapling processing Tb1 to staple a bundle of the sheets P1S, P2S and P3S, which have been accumulated on the stacker 40 with their rear ends being aligned.

When shortening an interval between the sheets fed from the image-forming apparatus 100, a processing speed can be increased but a period of time that is necessary for performing the sheet-stapling processing in the sheet-processing apparatus 1A gets longer than the interval between the sheets fed from the image-forming apparatus 100.

The timing of feeding the next sheet P4S during the sheet-feeding processing T and the sheet-stapling processing Tlb in which the preceding sheets P1S through P3S are stapled are overlapped. This prevents the next sheet P4S from being conveyed to the sheet-stapling portion 4. Thus, the sheet-processing apparatus 1A performs the sheet-waiting processing to allow the next sheet P4S to wait on the waiting portion 5 without stopping the feeding of the sheet from the image-forming apparatus 100 while the sheet-stapling portion 4 performs the sheet-stapling processing on the preceding sheets P1S through P3S.

In sheet-waiting processing T4*a* to allow the sheet P4S next the sheet P3S to wait, the controller 10 controls the conveying guide 52 to change over the sheet-conveying path from the stacker 40 to the temporary reservation part 50 and to convey the sheet P4S next the sheet P3S from the sheet-processing conveying path 3 to the temporary reservation part 50.

When conveying the sheet P4S to the temporary reservation part 50, the controller 10 controls the conveying guide 53 to change over the sheet-conveying path to the waiting conveying path 51 to adversely convey the sheet P4S on the sheet-processing conveying path 3 and to convey the sheet P4S to the waiting conveying path 51 so that the sheet P4S retreats on the waiting conveying path 51 until a forward end of the sheet P4S reaches the join and waiting position K. The controller 10 then temporarily stops the conveyance of the sheet P4S.

The controller 10 then conveys the sheet P5S next the sheet P4S on the sheet-processing path 3 along a regular direction until a forward end of the sheet P5S reaches the join and waiting position K so that the forward ends of the sheets P4S and P5S are aligned. By conveying the sheets P4S and P5S with their forward ends being aligned along the regular direction, they are conveyed to the temporary reservation part 50 while the sheet P5S is put on the sheet P4S.

The controller 10 then conveys the sheets P4S and P5S conveyed to the temporary reservation part 50 to retreat on the waiting conveying path 51 until the forward ends of the sheet P4S and P5S reach the join and waiting position K. The controller 10 then temporarily stops the conveyance of the sheets P4S and P5S.

Similarly, the controller 10 conveys the sheet P6S next the sheet P5S on the sheet-processing path 3 along the regular direction until a forward end of the sheet P6S reaches the join and waiting position K so that the forward ends of the sheets P4S, P5S and P6S are aligned. By conveying the sheets P4S, P5S and P6S with their forward ends being aligned along the regular direction, they are conveyed to the temporary reservation part 50 while the sheet P6S is put on the sheets P4S and P5S.

The controller 10 then conveys the sheets P4S, P5S and P6S conveyed to the temporary reservation part 50 to retreat on the waiting conveying path 51 until the forward ends of the sheet P4S, P5S and P6S reach the join and waiting position K. The controller 10 then temporarily stops the conveyance of the sheets P4S, P5S and P6S. During the sheet-waiting processing T4*a* as described above, it is possible to wait the following sheets P4S, P5S and P6S (first type of sheet) on the waiting conveying path 51 without stopping the feeding of the sheets from the image-forming apparatus 100 while in the processing mode, the sheet-stapling portion 4 performs the sheet-stapling processing on the preceding sheets P1S, P2S and P3S (second type of sheets).

When finishing the sheet-stapling processing T1*b* to staple the bundle of the preceding sheets P1S, P2S and P3S and performing the sheet-ejecting processing T1*c* to eject them from the stacker 40, the following sheets P4S, P5S and P6S conveyed on the waiting conveying path 51 are accumulated on the stacker 40 and a sheet-ejecting processing T4*c* is then performed to eject the sheets P4S, P5S and P6S accumulated on the stacker 40 without stapling them.

The controller 10 then performs sheet-waiting processing T7*a* to convey the sheets P7S and the like following the sheet P6S to the waiting portion 5 based on the processing similar to the sheet-waiting processing T4*c* of the sheets P4S, P5S and P6S while the sheets P4S, P5S and P6S are conveyed to the sheet-stapling portion 4 and the sheet-ejecting processing T4*c* to eject them from the sheet-ejecting portion 4 is performed.

When performing the sheet-ejecting processing T4*c* to eject the preceding sheets P4S, P5S and P6S, the following sheets P7S, P8S and P9S conveyed to the waiting conveying path 51 are accumulated on the stacker 40 and a sheet-stapling processing T7*b* to staple a bundle of the sheets P7S, P8S and P9S accumulated on the stacker 40 by the stapler 41 is performed.

When there is no sheet to be next conveyed, the controller 10 operates to finish the sheet-stapling processing T7*b* to staple the bundle of the sheets P7S, P8S and P9S and perform a sheet-ejecting processing T7*c* to ejecting them from the stacker 40. The controller 10 then finishes the stapling mode.

As described above, in the case where the non-stapling mode follows the stapling mode and the same conveying path mode is selected in which the sheet-conveying path is the sheet-processing conveying path 3, the sheet-waiting processing is performed in which the following sheets in the non-stapling mode are conveyed to the waiting portion 5 while the sheet-stapling portion 4 performs the sheet-stapling processing on the preceding sheets in the stapling mode.

Accordingly, even when the period of time that is necessary for performing the sheet-stapling processing gets longer than the interval between the sheets fed from the image-forming apparatus 100, it is possible to perform the staple mode and the non-staple mode continuously without stopping the feeding of the sheets from the image-forming apparatus 100.

Therefore, the sheet-processing apparatus 1A can save a period of time for waiting the sheets and improve the productivity. The order of the sheets ejected to the main tray 6 corresponds to the order of the sheets fed from the image-forming apparatus 100.

Figure 8:
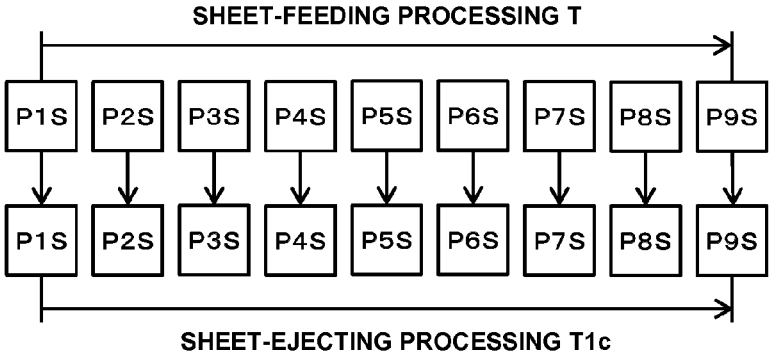
FIG. 8 is a timing chart showing an operation example of the sheet-processing apparatus when ejecting sheets in a case where the non-stapling modes are continuous.

FIG. 8 shows an operation example of the sheet-processing apparatus 1A when it ejects the sheets in a case where the non-stapling modes are continuous. FIG. 8 schematically shows timings of sheet-feeding processing and sheet-ejecting processing. FIG. 8 shows, as a case where the sheets are ejected without stapling them, a case where nine sheets are ejected without stapling them. Here, the sheets P1S through P9S are not to be stapled.

In the non-stapling mode, the controller 10 controls the conveying guide 23 shown in FIG. 1 to change over the sheet-conveying path to the main conveying path 2 and to convey the sheets fed from the image-forming apparatus 100 to the main conveying path 2. During the sheet-feeding proceeding T from the image-forming apparatus 100, the main controller 102 of the image-forming apparatus 100 feeds the sheets at fixed timing.

In the sheet-processing apparatus 1A, the controller 10 controls the conveying rollers 20 and the like to convey the sheets P1S through P9S fed one by one during the sheet-feeding proceeding T from the image-forming apparatus 100 to the main conveying path 2 one by one in order and to eject them to the main tray 6 to accumulate them thereon.

In the non-stapling mode, the sheet-processing apparatus 1A may meet sheet-ejecting timing in the sheet-ejecting processing T1*c* to eject the sheets to the main tray 6 to sheet-feeding timing in the sheet-feeding processing T to feed the sheets from the image-forming apparatus to the sheet-processing apparatus 1A.

Figure 9:
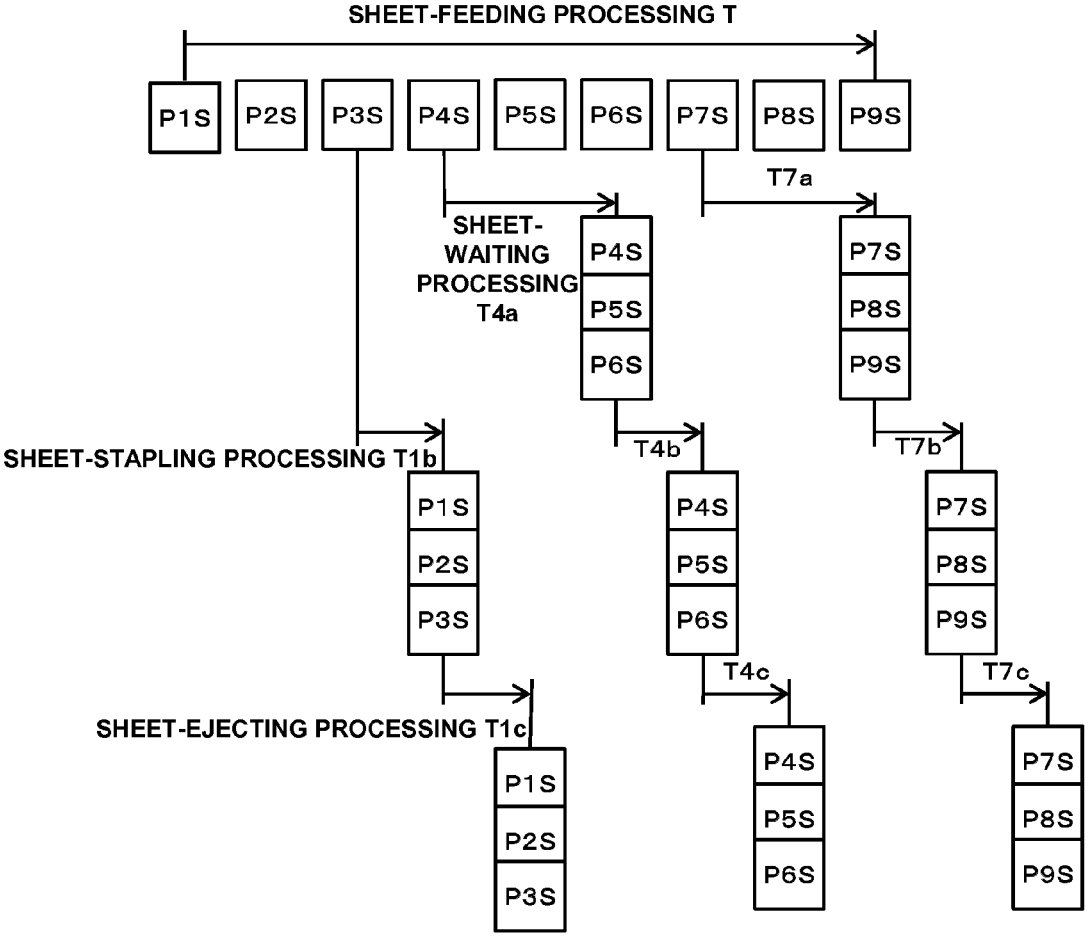
FIG. 9 is a timing chart showing an operation example of the sheet-processing apparatus when ejecting sheets in a case where the stapling modes are continuous.

FIG. 9 shows an operation example of the sheet-processing apparatus 1A when ejecting sheets in a case where the stapling modes are continuous. FIG. 9 schematically shows timings of sheet-feeding processing, sheet-stapling processing, sheet-waiting processing and sheet-ejecting processing. FIG. 9 shows, as a case where the stapling modes are continuous, a case where the sheet-stapling processing is performed on every three sheets. Here, the sheets P1S through P9S are to be stapled.

In the stapling mode, the controller 10 controls the conveying guide 23 shown in FIG. 1 to change over the sheet-conveying path to the sheet-processing conveying path 3 and to convey the sheets fed from the image-forming apparatus 100 to the sheet-processing conveying path 3. During the sheet-feeding proceeding T from the image-forming apparatus 100, the main controller 102 of the image-forming apparatus 100 feeds the sheets at fixed timing.

In the sheet-processing apparatus 1A, the controller 10 controls the conveying rollers 30 and the like to convey the sheets, which are fed one by one from the image-forming apparatus 100 during the sheet-feeding proceeding T, in order to the sheet-processing conveying path 3 and to accumulate them on the stacker 40. In this embodiment, first three sheets P1S, P2S and P3S are conveyed in order on the sheet-processing conveying path 3 and accumulated on the stacker 40.

The controller 10 controls the stapler 41 to perform the sheet-stapling processing Tb1 to staple a bundle of the sheets P1S, P2S and P3S, which have been accumulated on the stacker 40 with their rear ends being aligned.

When the timing of feeding the next sheet P4S during the sheet-feeding processing T and the sheet-stapling processing Tlb in which the preceding sheets P1S through P3S are stapled are overlapped, the sheet-processing apparatus 1A performs the sheet-waiting processing to allow the next sheet P4S to wait on the waiting portion 5 without stopping the feeding of the sheet P4S from the image-forming apparatus 100 while the sheet-processing portion 4 performs the sheet-stapling processing on the preceding sheets P1S through P3S.

In the sheet-waiting processing T4*a* to allow the sheet P4S next the sheet P3S to wait, the controller 10 controls the conveying guide 52 to change over the sheet-conveying path from the stacker 40 to the temporary reservation part 50 and to convey the sheet P4S from the sheet-processing conveying path 3 to the temporary reservation part 50.

When conveying the sheet P4S to the temporary reservation part 50, the controller 10 controls the conveying guide 53 to change over the sheet-conveying path to the waiting conveying path 51 to adversely convey the sheet P4S on the sheet-processing conveying path 3 and to convey the sheet P4S to the waiting conveying path 51 so that the sheet P4S retreats on the waiting conveying path 51 until a forward end of the sheet P4S reaches the join and waiting position K. The controller 10 then temporarily stops the conveyance of the sheet P4S.

The controller 10 conveys the sheet P5S next the sheet P4S on the sheet-processing path 3 along a regular direction until a forward end of the sheet P5S reaches the join and waiting position K so that the forward ends of the sheets P4S and P5S are aligned. By conveying the sheets P4S and P5S with their forward ends being aligned along the regular direction, they are conveyed to the temporary reservation part 50 while the sheet P5S is put on the sheet P4S.

The controller 10 then conveys the sheets P4S and P5S conveyed to the temporary reservation part 50 to retreat on the waiting conveying path 51 until the forward ends of the sheets P4S and P5S reach the join and waiting position K. The controller 10 then temporarily stops the conveyance of the sheets P4S and P5S.

Similarly, the controller 10 conveys the sheet P6S next the sheet P5S on the sheet-processing path 3 along the regular direction until a forward end of the sheet P6S reaches the join and waiting position K so that the forward ends of the sheets P4S, P5S and P6S are aligned. By conveying the sheets P4S, P5S and P6S with their forward ends being aligned along the regular direction, they are conveyed to the temporary reservation part 50 while the sheet P6S is put on the sheets P4S and P5S.

The controller 10 then conveys the sheets P4S, P5S and P6S conveyed to the temporary reservation part 50 to retreat on the waiting conveying path 51 until the forward ends of the sheets P4S, P5S and P6S reach the join and waiting position K. The controller 10 then temporarily stops the conveyance of the sheets P4S, P5S and P6S.

When finishing the sheet-stapling processing T1*b* to staple the bundle of the preceding sheets P1S, P2S and P3S and performing the sheet-ejecting processing T1*c* to eject them from the stacker 40, the following sheets P4S, P5S and P6S conveyed on the waiting conveying path 51 are accumulated on the stacker 40 and a stapling processing T4*b* to staple a bundle of the sheets P4S, P5S and P6S accumulated on the stacker 40 by the stapler 41 is then performed.

The controller 10 then performs sheet-waiting processing T7*a* to convey the sheets P7S and the like following the sheet P6S to the waiting portion 5 based on the processing similar to the sheet-waiting processing T4*a* of the sheets P4S, P5S and P6S while the sheet-stapling portion 4 performs the sheet-stapling processing T4*b* on the sheets P4S, P5S and P6S.

When finishing the sheet-stapling processing T4*b* to staple a bundle of the preceding sheets P4S, P5S and P6S and performing the sheet-ejecting processing T4*c* to eject the preceding sheets P4S, P5S and P6S from the stacker 40, the following sheets P7S, P8S and P9S conveyed to the waiting conveying path 51 are accumulated on the stacker 40 and a sheet-stapling processing T7*b* to staple a bundle of the sheets P7S, P8S and P9S accumulated on the stacker 40 by the stapler 41 is then performed.

When there is no sheet to be next conveyed, the controller 10 finishes the sheet-stapling processing T7*b* to staple the bundle of the sheets P7S, P8S and P9S and performs a sheet-ejecting processing T7*c* to ejecting them from the stacker 40. The controller 10 then finishes the stapling mode.

As described above, in the case where the stapling modes are continuous, the sheet-waiting processing in which the following sheets are conveyed to the waiting portion 5 while the sheet-stapling portion 4 performs the sheet-stapling processing on the preceding sheets.

Accordingly, even when the period of time that is necessary for performing the sheet-stapling processing gets longer than the interval between the sheets fed from the image-forming apparatus 100, it is possible to perform the sheet-stapling processing without stopping the feeding of the sheets from the image-forming apparatus 100.

Figure 10:
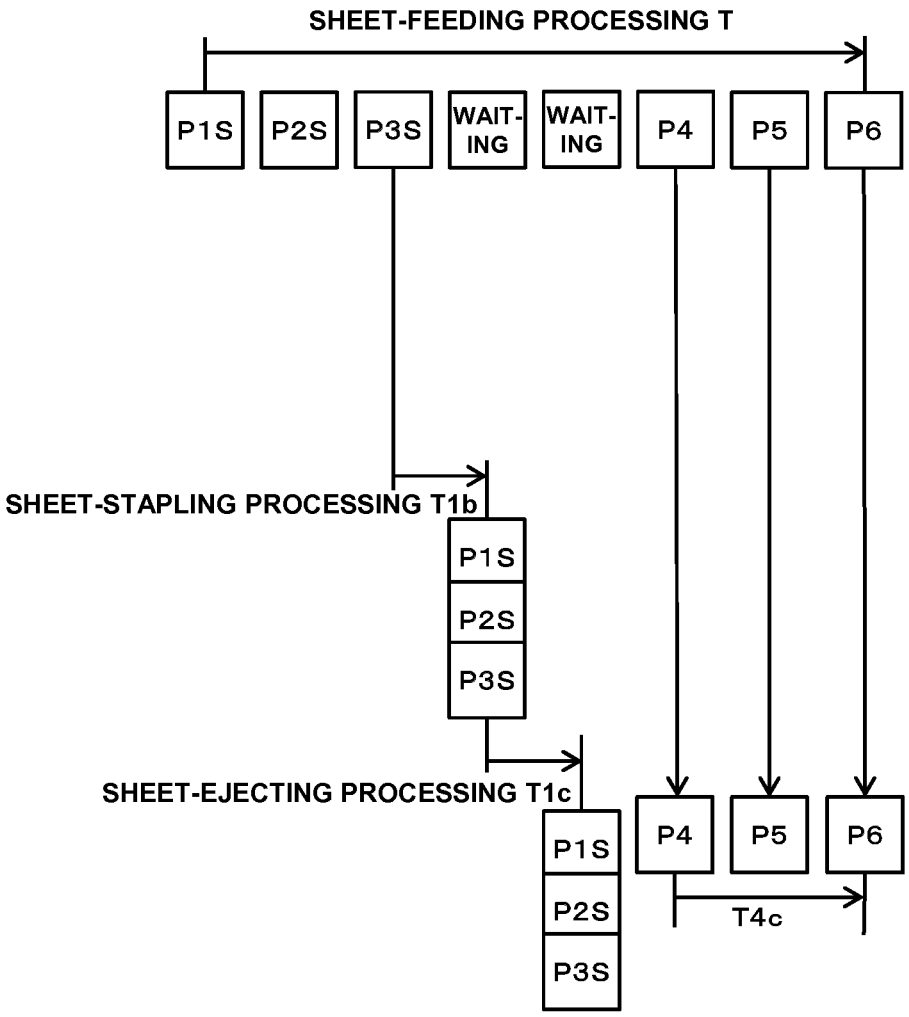
FIG. 10 is a timing chart showing an operation example of the sheet-processing apparatus when the non-stapling mode follows the stapling mode and the conveying path change mode is selected.

FIG. 10 shows an operation example of the sheet-processing apparatus 1A when the non-stapling mode follows the stapling mode and the conveying path change mode is selected. FIG. 10 schematically shows timings of sheet-feeding processing, sheet-stapling processing, sheet-waiting processing and sheet-ejecting processing. FIG. 10 shows, as a case where the non-stapling mode follows the stapling mode, a case where three sheets are ejected with stapling them and next three sheets are ejected without stapling them. Here, the sheets P1S through P3S are to be stapled and the sheets P4 through P6 are not to be stapled.

In a case where the non-stapling mode follows the stapling mode and the conveying path change mode in which the sheet-conveying path is changed over for each mode is selected, the controller 10 controls the conveying guide 23 shown in FIG. 1 to change over the sheet-conveying path to the sheet-processing conveying path 3 and to convey the sheets fed from the image-forming apparatus 100 to the sheet-processing conveying path 3.

In the sheet-processing apparatus 1A, the controller 10 controls the conveying rollers 30 and the like to convey the sheets, which are fed one by one from the image-forming apparatus 100 during the sheet-feeding proceeding T, in order to the sheet-processing conveying path 3 and to accumulate them on a stacker 40. In this embodiment, first three sheets P1S, P2S and P3S are conveyed in order on the sheet-processing conveying path 3 and are accumulated on the stacker 40.

The controller 10 controls the stapler 41 to perform the sheet-stapling processing Tb1 to staple a bundle of the sheets P1S, P2S and P3S, which have been accumulated on the stacker 40 with their rear ends being aligned.

When conveying the sheet P3S to the sheet-processing conveying path 3, the controller 10 controls the conveying guide 23 to change over the sheet-conveying path to the main conveying path 2. In the image-forming apparatus 100, the main controller 102 meets a feeding timing to feed the sheets during sheet-feeding processing T with a timing to staple the bundle of the preceding sheets P1S, P2S and P3S and to eject it. The main controller 102 temporarily stops feeding the sheets from the image-forming apparatus 100.

When finishing the sheet-stapling processing T1*b* to staple the bundle of the preceding sheets P1S, P2S and P3S and performing the sheet-ejecting processing T1*c* to eject the sheets from the stacker 40, the main controller 102 restarts feeding the sheets from the image-forming apparatus 100 so that the sheets fed from the image-forming apparatus 100 are conveyed on the main conveying path 2 one by one.

In the sheet-processing apparatus 1A, the controller 10 controls the conveying rollers 20 and the like to convey the sheets P4 through P6, which are fed one by one during the sheet-feeding proceeding T from the image-forming apparatus 100, to the main conveying path 2 one by one in order and to eject them to the main tray 6 to accumulate them thereon.

In the embodiment, the case has been described in which the sheet-processing apparatus 1A contains the sheet-stapling portion 4 to staple a bundle of the sheets as the sheet-processing portion and the sheet-stapling portion 4 staples the bundle of the sheets as the sheet processing.

This invention is not limited thereto: The invention is applied to other case where the sheet-processing apparatus 1A contains other sheet-processing portion to perform other species of sheet processing such as sheet-folding processing to fold the sheet, sheet-punching processing to punch the sheet, sheet-cutting processing to cut the sheet and sheet-creasing processing to crease the sheet.

As described above, in the embodiment, when the controller 10 of the sheet-processing apparatus 1A judges that the non-processing mode in which the sheets are ejected without being performed any sheet processing on the sheets follows the processing mode in which the sheets are ejected with performing any sheet processing on the sheets, the controller 10 has changed over the sheet-conveying path for the sheet to be ejected without being performed any sheet processing to the sheet-processing conveying path 3 based on the predetermined sheet-conveying path selection information. In the same conveying path mode in which the sheet-conveying path for the sheet to be ejected without being performed any sheet processing is the sheet-processing conveying path 3, the controller 10 has performed the sheet-waiting processing to convey the following sheets to the waiting portion 5 in the non-stapling mode while the sheet-processing portion performs any sheet processing on the preceding sheets in the processing mode.

According to the embodiment, even when the period of time that is necessary for performing the sheet processing gets longer than the interval between the sheets fed from the image-forming apparatus 100, it is possible to perform the processing mode and the non-processing mode continuously without stopping the feeding of the sheets from the image-forming apparatus 100.

Therefore, the sheet-processing apparatus 1A can save a period of time for waiting the sheets and improve the productivity. The order of the sheets ejected to the main tray 6 corresponds to the order of the sheets fed from the image-forming apparatus 100.

As described above, in the embodiment, in the case where the non-processing mode follows the processing mode and the conveying path change mode in which the sheet-conveying path is changed over for each mode is selected, it may be necessary for the sheets to wait at a side of the image-forming apparatus 100 while the sheet-processing portion performs the sheet processing on the preceding sheets in the processing mode. This causes a period of processing time to get longer. On the other hand, in this embodiment, since it is possible to convey the sheets, which are ejected without being performed any sheet processing, to the main conveying path 2, it is possible to avoid conveying the sheet, which is unsuitable for being conveyed on the sheet-processing conveying path 3 having a curved portion, on the sheet-processing conveying path 3.

It should be understood by those skilled in the art that various modifications, combinations, sub-combinations and alterations may occur depending on design requirements and other factors insofar as they are within the scope of the appended claims or the equivalents thereof.

The invention claimed is:

1. A sheet-processing apparatus comprising:
a main conveying path;
a branch path different from the main conveying path;
a sheet-processing portion that performs sheet processing on a sheet in the branch path; and
a controller which controls conveyance of sheets and which executes functions comprising:
receiving information regarding modes set for each of the sheets, the modes including a processing mode in which a sheet is processed by the sheet-processing portion and a non-processing mode in which a sheet is not processed by the sheet-processing portion, wherein in the non-processing mode the sheet is not stapled and the sheet is not folded; and
when a sheet conveyed in the non-processing mode follows a sheet conveyed in the processing mode, performing control to send the sheet conveyed in the non-processing mode to one of the main conveying path and the branch path based on predetermined sheet-conveying path selection information;
wherein the sheet-conveying path selection information is set based on processing time information obtained by comparing (i) a period of processing time that is necessary for conveying the sheet conveyed in the non-processing mode following the sheet conveyed in the processing mode on the main conveying path with (ii) a period of processing time that is necessary for conveying the sheet conveyed in the non-processing mode following the sheet conveyed in the processing mode on the branch path, and
wherein the controller calculates the period of processing time that is necessary for conveying the sheet conveyed in the non-processing mode following the sheet conveyed in the processing mode on the main conveying path and the period of processing time that is necessary for conveying the sheet conveyed in the non-processing mode following the sheet conveyed in the processing mode on the branch path, and changes over a sheet-conveying path based on the calculated processing time information.

2. The sheet-processing apparatus according to claim 1, wherein the sheet-processing portion comprises a sheet-stapling portion that staples a plurality of the sheets.

3. The sheet-processing apparatus according to claim 1, wherein the sheet-conveying path selection information is set based on sheet number information on sheets conveyed in the non-processing mode following conveyance of sheets in the processing mode.

4. The sheet-processing apparatus according to claim 1, wherein the sheet-conveying path selection information is set based on sheet-species information on the sheet conveyed in the non-processing mode.

5. The sheet-processing apparatus according to claim 1, wherein alignment information is set according to a sheet-conveying path to which conveyance of sheets is changed when conveyance of sheets in the non-processing mode follows conveyance of sheets in the processing mode, the alignment information being used to determine whether an alignment of the sheets is to be performed on a main tray to which the sheets are ejected.

6. The sheet-processing apparatus according to claim 1, further comprising a tray to which sheets sent to the main conveying path and the branch path are ejected.

7. An image-forming system comprising:
an image-forming apparatus that forms images on sheets;
a sheet-processing apparatus that conveys the sheets fed from the image-forming apparatus, the sheet-processing apparatus comprising:
a main conveying path;
a branch path different from the main conveying path;
a sheet-processing portion that performs sheet processing on a sheet in the branch path; and
a controller which controls conveyance of sheets and which executes functions comprising:
receiving information regarding modes set for each of the sheets, the modes including a processing mode in which a sheet is processed by the sheet-processing portion and a non-processing mode in which a sheet is not processed by the sheet-processing portion, wherein in the non-processing mode the sheet is not stapled and the sheet is not folded; and
when a sheet conveyed in the non-processing mode follows a sheet conveyed in the processing mode, performing control to send the sheet conveyed in the non-processing mode to one of the main conveying path and the branch path based on predetermined sheet-conveying path selection information; and
a tray to which sheets sent to the main conveying path and the branch path are elected.

8. The image-forming system according to claim 7, further comprising a manipulation portion that receives an input by a user,
wherein the controller changes over a sheet-conveying path for the sheet conveyed in the non-processing mode to the one of the main conveying path and the branch path based on a selection indicated by the input by the user received by the manipulation portion, when it is determined that the sheet conveyed in the non-processing mode follows the sheet conveyed in the processing mode.

9. A sheet-processing apparatus comprising:
a main conveying path;
a branch path different from the main conveying path;
a sheet-processing portion that performs sheet processing on a sheet placed on the branch path;
a waiting portion placed at the branch path at an upper side position of the sheet-processing portion; and
a controller which controls conveyance of sheets and which executes functions comprising:
receiving information regarding modes set for each of the sheets, the modes including a processing mode in which a sheet is processed by the sheet-processing portion and a non-processing mode in which a sheet is not processed by the sheet-processing portion, wherein in the non-processing mode the sheet is not stapled and the sheet is not folded; and
when a sheet conveyed in the non-processing mode follows a sheet conveyed in the processing mode, performing control to send the sheet conveyed in the non-processing mode to the branch path following the sheet conveyed in the processing mode, and to hold the sheet conveyed in the non-processing mode in the waiting portion while the sheet conveyed in the processing mode in the branch path is processed by the sheet-processing portion.

10. The sheet-processing apparatus according to claim 9, wherein the waiting portion is configured to accommodate a plurality of the sheets.

11. The sheet-processing apparatus according to claim 9, wherein the waiting portion comprises:

a temporary reservation part that allows a sheet to escape from the branch path; and a waiting conveying path to which the sheet which escapes to the temporary reservation part is conveyed.

12. The sheet-processing apparatus according to claim 9, further comprising a tray to which sheets sent to the main conveying path and the branch path are ejected.

13. A sheet-processing apparatus comprising:

a main conveying path;

a branch path different from the main conveying path;

a sheet-processing portion that performs sheet processing on a sheet in the branch path;

a controller which controls conveyance of sheets and which executes functions comprising:

receiving information regarding modes set for each of the sheets, the modes including a processing mode in which a sheet is processed by the sheet-processing portion and a non-processing mode in which a sheet is not processed by the sheet-processing portion, wherein in the non-processing mode the sheet is not stapled and the sheet is not folded; and when a sheet conveyed in the non-processing mode follows a sheet conveyed in the processing mode, performing control to send the sheet conveyed in the non-processing mode to one of the main conveying path and the branch path based on predetermined sheet-conveying path selection information; and a tray to which sheets sent to the main conveying path and the branch path are ejected.

14. The sheet-processing apparatus according to claim 13, wherein the sheet-processing portion comprises a sheet-stapling portion that staples a plurality of the sheets.

15. The sheet-processing apparatus according to claim 13, wherein the sheet-conveying path selection information is set based on sheet number information on sheets conveyed in the non-processing mode following conveyance of sheets in the processing mode.

16. The sheet-processing apparatus according to claim 13, wherein the sheet-conveying path selection information is set based on sheet-species information on the sheet conveyed in the non-processing mode.

17. The sheet-processing apparatus according to claim 13, wherein the sheet-conveying path selection information is set based on processing time information obtained by comparing (i) a period of processing time that is necessary for conveying the sheet conveyed in the non-processing mode following the sheet conveyed in the processing mode on the main conveying path with (ii) a period of processing time that is necessary for conveying the sheet conveyed in the non-processing mode following the sheet conveyed in the processing mode on the branch path, and wherein the controller calculates the period of processing time that is necessary for conveying the sheet conveyed in the non-processing mode following the sheet conveyed in the processing mode on the main conveying path and the period of processing time that is necessary for conveying the sheet conveyed in the non-processing mode following the sheet conveyed in the processing mode on the branch path, and changes over a sheet-conveying path based on the calculated processing time information.

18. The sheet-processing apparatus according to claim 13, wherein alignment information is set according to a sheet-conveying path to which conveyance of sheets is changed when conveyance of sheets in the non-processing mode follows conveyance of sheets in the processing mode, the alignment information being used to determine whether an alignment of the sheets is to be performed on a main tray to which the sheets are ejected.

* * * * *